US005494217A

United States Patent [19]

Suzuki

[11] Patent Number: 5,494,217

[45] Date of Patent: Feb. 27, 1996

[54] SAVINGS BANK WITH OPTICAL ILLUSION COIN CONCEALMENT CHUTE

[75] Inventor: Tooru Suzuki, Tokyo, Japan

[73] Assignee: Tenyo Co., Ltd., Tokyo, Japan

[21] Appl. No.: 258,289

[22] Filed: Jun. 10, 1994

[30] Foreign Application Priority Data

Jun. 10, 1993 [JP] Japan ..... 5-030900 U

[51] Int. Cl.[6] ..... A45C 1/12

[52] U.S. Cl. ..... 232/1 D; 446/8; 40/427; 40/900

[58] Field of Search ..... 232/1 D, 57, 55; 446/8, 9, 10; 40/427, 900, 219; 472/63

[56] References Cited

U.S. PATENT DOCUMENTS

| | | | |
|---|---|---|---|
| 282,978 | 8/1883 | Goudie | 446/8 |
| 296,689 | 4/1884 | Hart | 446/8 |
| 1,679,658 | 8/1928 | Hall | 446/9 |
| 2,804,719 | 9/1957 | Glass | 446/9 |
| 4,967,953 | 11/1990 | Sugawara | 446/8 |
| 5,282,765 | 2/1994 | Suzuki | 446/8 |
| 5,348,220 | 9/1994 | Setteducati | 446/10 |

*Primary Examiner*—Flemming Saether
*Attorney, Agent, or Firm*—Sixbey, Friedman, Leedom & Ferguson; Gerald J. Ferguson, Jr.; Davis S. Safran

[57] ABSTRACT

A coin concealment and back screen are disposed upright on a coin-receiving case. Two mirrors are provided on the coin concealment, and camouflaging members and an oscillating coin chute are provided on the coin concealment. Since the mirrors reflect the surface of the back screen, so an illusion that the coin concealment done exist and only the camouflaging members and the back screen stand there. As a result, when a coin is put in to the coin concealment via the coin chute, the coin is hidden behind the coin concealment, so an illusion that the coin is missing will be given. Also, as the coin moves, the coin chute oscillates reciprocally. Namely, the motion of the coin chute adds to the illusion of coin missing to enhance the fun to see.

4 Claims, 8 Drawing Sheets

SAVINGS BANK WITH OPTICAL ILLUSION COIN CONCEALMENT CHUTE

BACKGROUND OF THE INVENTION a) Field of the Invention

The present invention relates to a savings box using mirrors to give an illusion of coin missing, and more particularly, to a savings box having a coin chute which receives a coin put into the box and oscillates as the coin rolls down thereon.

b) Related Art Statement

There have so far been proposed various savings boxes adapted to give an illusion that a coin put into them is missing, including, for example, a one known from the disclosure in the U.S. Pat. No. 4,967,953. This savings box comprises a generally cubic body composed of six light-opaque panels. A fight transparent window is formed in the front of one of the six panels. A partition is disposed in a plane defined by one of the diagonals of the top panel and one of the diagonals of the bottom panel, which is parallel to that diagonal of the top panel. The partition divides the internal space of the box body into two half spaces. A mirror is fixed on the side of the partition, that is opposite to the light-transparent window in the front panel. The top panel has formed therein a coin slot which communicates with a half space at the rear side of the partition, opposite to the rear panel. This rear half space is to receive coins which are put into the box through the coin slot. When the savings box inside is viewed through the light-transparent window from outside, it will appear like a hollow box without any mirror and partition owing to the reflection by the mirror. Therefore, an illusion that a coin put into the savings box and actually received in the half space behind the rear panel is missing from the savings box, will be given.

SUMMARY OF THE INVENTION

The present invention has an object to provide a novel and improved savings box giving an illusion that a coin put into the box is missing or has gone to somewhere as well as having a motion of a coin chute which receives a coin put into the box and oscillates as the coin rolls down thereon.

The above object is accomplished by providing a savings box comprising, according to the present invention, a coin-receiving hollow case having a through-hole formed in the top thereof; a coin concealment disposed upright on the top of the coin-receiving case, having an internal space communicating with the through-hole in the coin-receiving case, a bottom opening communicating with the through-hole in the coin-receiving case and a slot through which a coin is to be received; two mirrors fixed on outer faces of the coin concealment with the slot placed between the outer faces; a camouflaging member attached to the coin concealment to cover the slot in the coin concealment from outside; a back screen disposed upright on the top of the coin-receiving case and having a camouflaging face opposite to the two mirrors; and a coin chute attached to the coin concealment in such a manner that it can be oscillated, one of the ends thereof being exposed outside the slot in the coin concealment while the other end is disposed in the coin concealment, a coin passage being formed in the coin chum from the one to the other end. The camouflaging face stands upright on the top of ihe coin-receiving case along with the camouflaging member, but the two mirrors and coin concealment are so disposed as not to visible due to reflection by the mirrors.

The coin chute is so arranged as to oscillate as a coin put in rolls on the coin passage from the center of oscillation to the other end thereof.

In the savings box according to the present invention, the camouflaging member and camouflaging face are visible but the coin concealment is not, both due to the reflection by the mirrors. A coin put on the one end of the coin chute rolls on the coin passage and falls into the coin-receiving case. Since the movement of the coin is hidden behind the coin concealment, however, an illusion that the coin is missing, will be given. Besides, the coin chute oscillates reciprocally as the coin rolls along it. This motion will further enhance the fun to use the savings box.

BRIEF DESCRIPTION OF THE DRAWINGS

The present invention will be better understood from the ensuing description, made by way of example, of the embodiment of the savings box according to the present invention with reference to the drawings.

FIGS. 8A through 8D show together the coin concealment, of which FIG. 8A is a left side elevation of the left half of the coin concealment, FIG. 8B is a front view of the left half, FIG. 8C is a right side elevation of the left half, and FIG. 8D is a bottom view of the left half;

DETAILED DESCRIPTION OF THE PREFERRED EMBODIMENT

Figure 1:
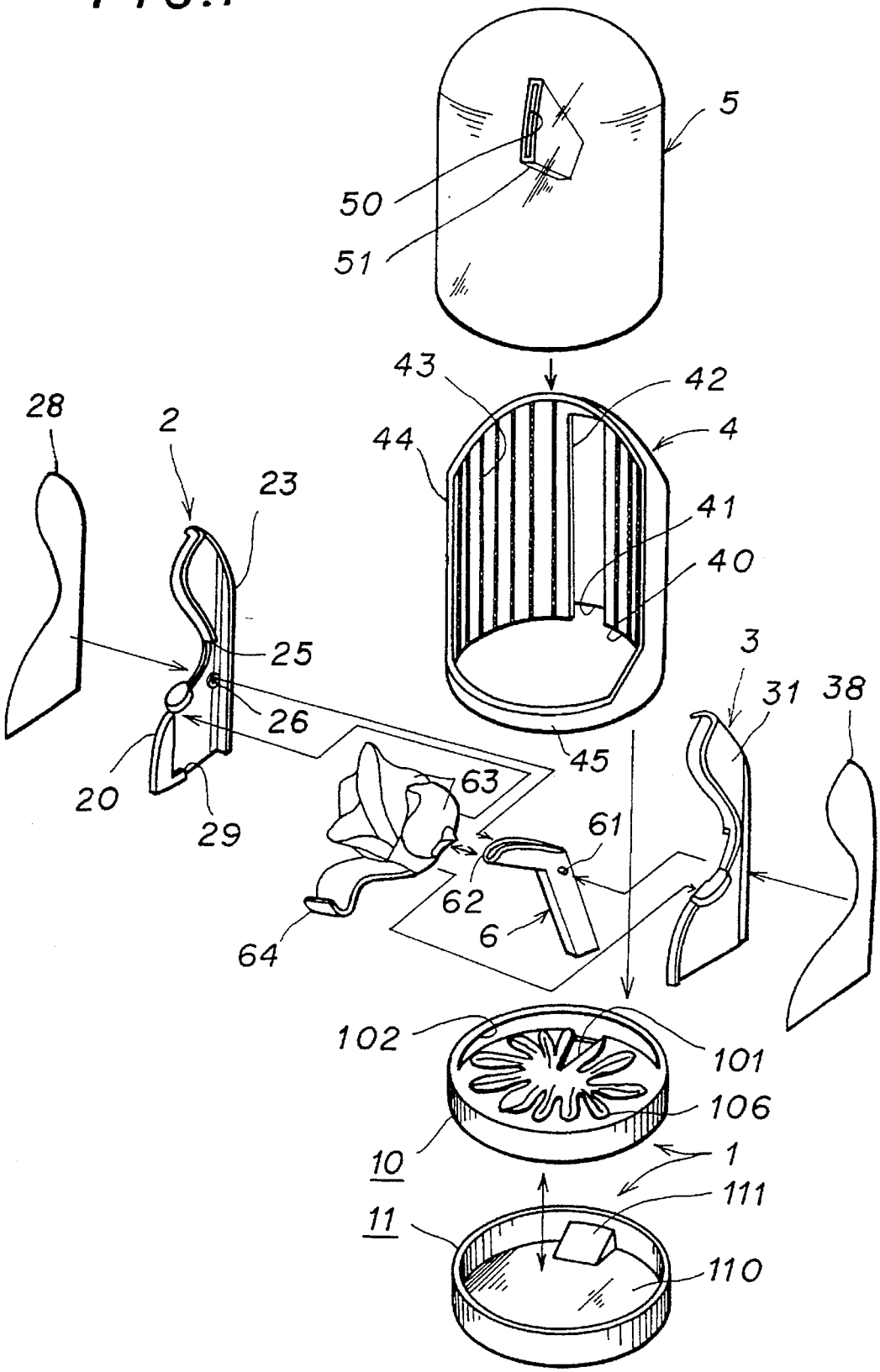
FIG. 1 is a perspective view of an assembled embodiment of the savings box according to the present invention.
Figure 6:
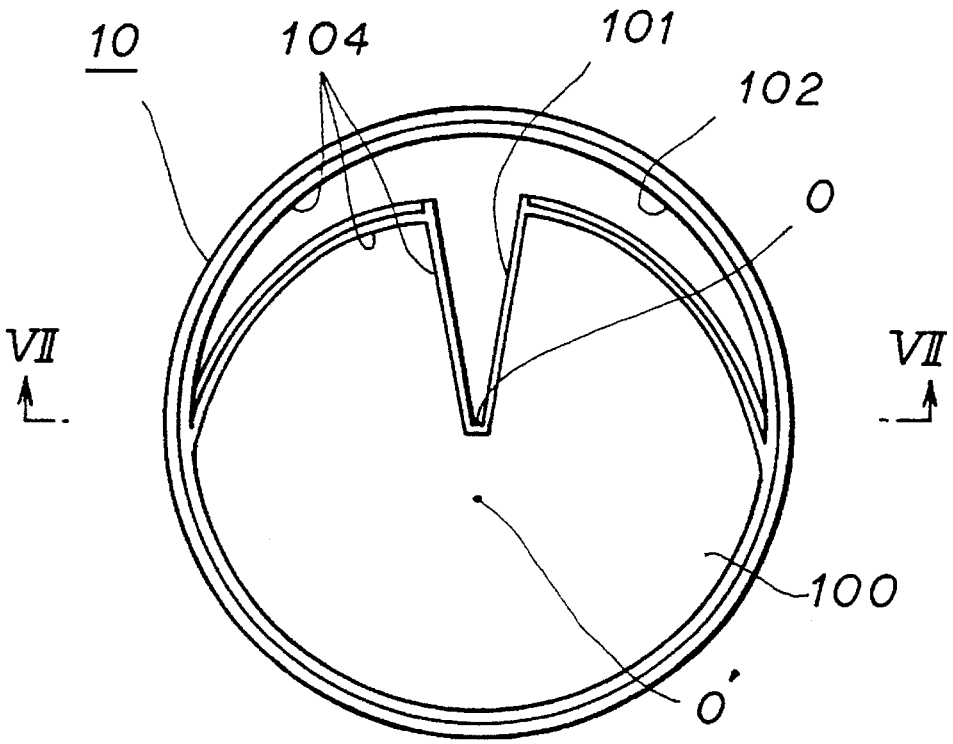
FIG. 6 is a top plan view of the coin-receiving case.
Figure 7:
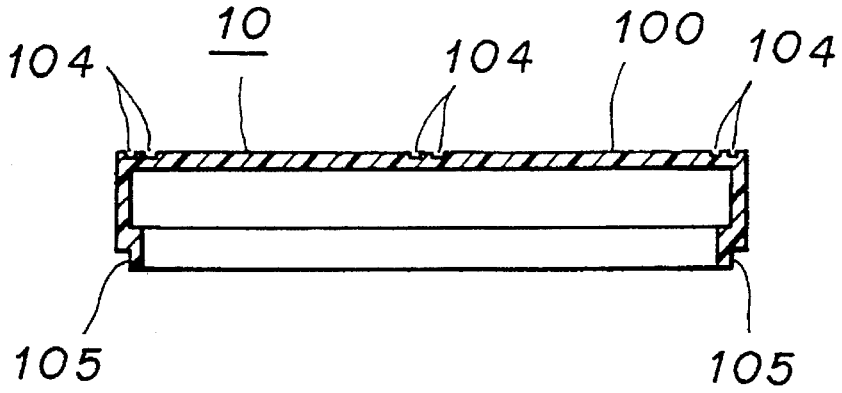
FIG. 7 is a sectional view taken along the line VII—VII.
Figure 8A:
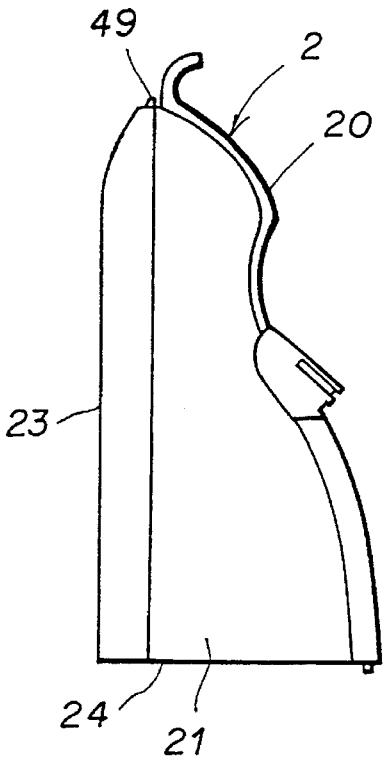
Figure 8B:
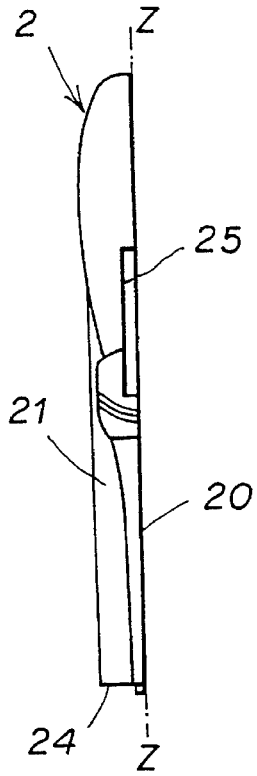
Figure 8C:
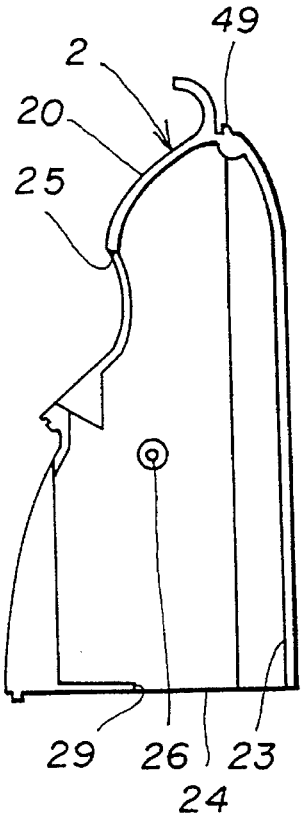
Figure 8D:
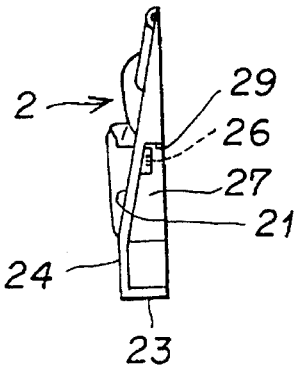
Figure 9:
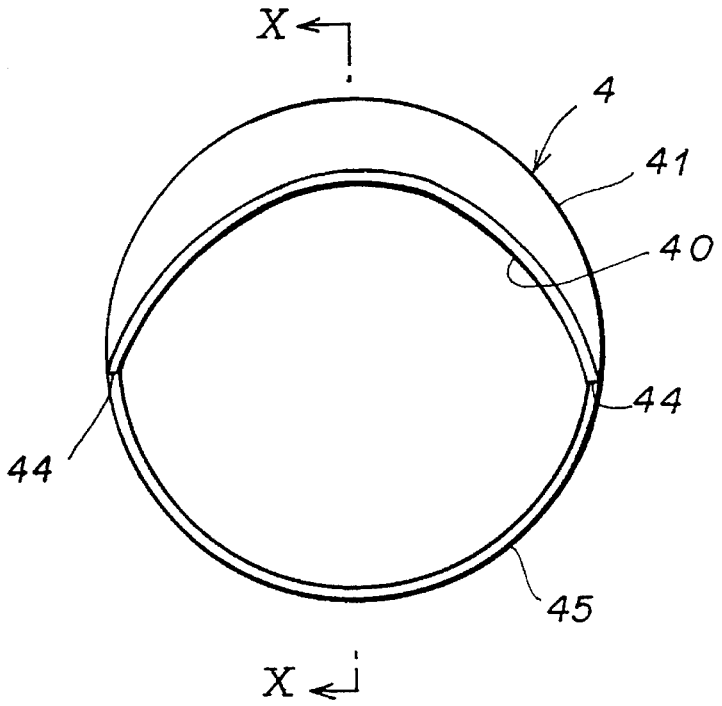
FIG. 9 is a plan view of the back screen.
Figure 10:
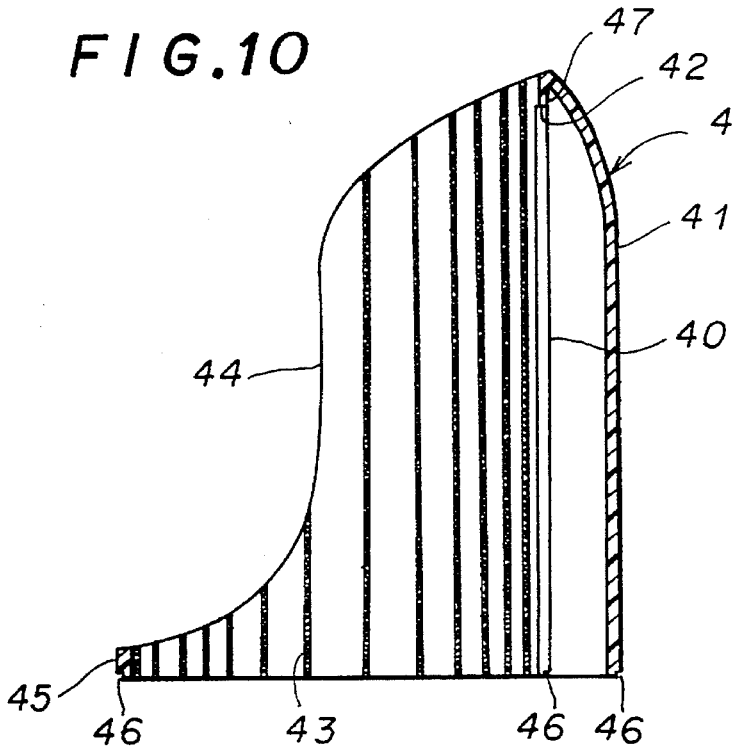
FIG. 10 is a sectional view taken along the line X—X in FIG. 9.

Referring now to FIG. 1, the savings box according to the present invention comprises a coin-receiving hollow cylindrical case generally indicated with the reference numeral 1. The case 1 consists of an upper case member 10 open at the bottom thereof and a lower case member 11 open at the top thereof. These case members 10 and 11 are made of a light-opaque synthetic resin, for example. As seen from FIG. 6, the upper case member 10 has a top plate 100 in which a narrow sector-like through-hole 101 and a generally crescent-like cut 102 are formed contiguously to each other. The inner circular arc of the cut 102 is a part of a circle taking as its center a position 0' somewhat deviated from a center 0 of the top plate 100. There are formed engagement recesses 104 all around the top plate 100 and along the edges of the through-hole 101 and cut 102, respectively. The upper case member 10 has formed along the bottom outer circumference thereof a step 105 at which the upper case member 10 is to be fitted into the lower case member 11. The top plate 100 of the upper case 10 has fixed thereon an ornamental member 106 designed like leaves of a rose, for example. Note that the ornamental member 106 is not shown in FIGS. 6 and 7.

Figure 2:
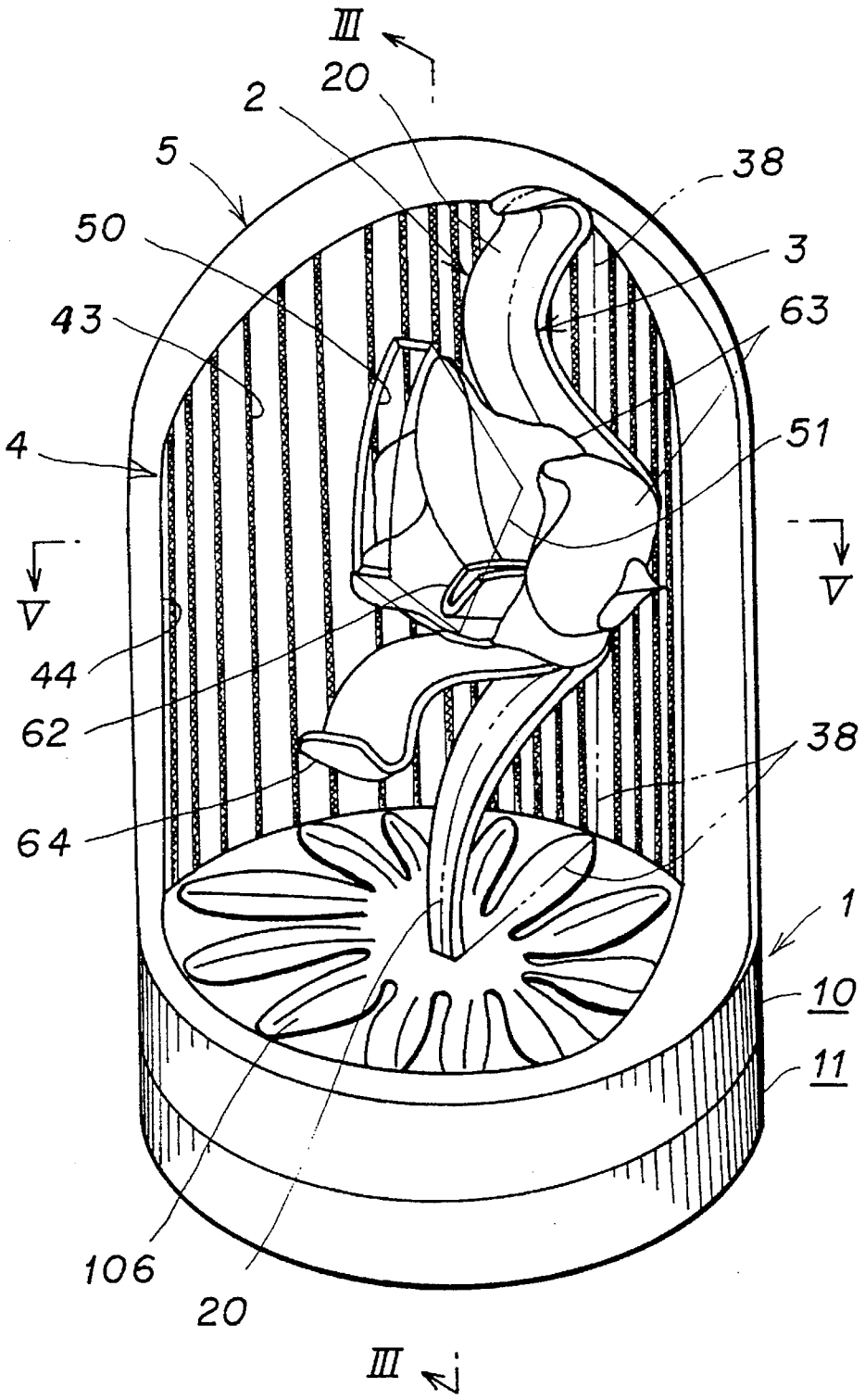
FIG. 2 is an exploded perspective view of the above embodiment.

As shown in FIG. 2, there is fixed on the bottom plate 110 of the lower case member 11, in a position corresponding to the through-hole 101 in the upper case member 10, a triangular piece 111 at which a coin received into the case 1 is moved as reflected deeper into the case 1. The upper case member 10 and lower case member 11 may be otherwise coupled to each other. For example, they may be coupled together by screwing instead of by the above-mentioned fitting.

The savings box in this embodiment includes coin concealing members generally indicated with the reference numerals 2 and 3, respectively. They are disposed as upright on the top plate 100 of the case 1 and along the sector-like through-hole 101. As seen from FIG. 5, they are assembled together in symmetry with respect to a center line Z—Z of the top plate 100. Namely, these members 2 and 3 are coupled to each other appropriately, for example, by fitting, to form a coin concealment generally indicated with the reference numeral 8.

Figure 5:
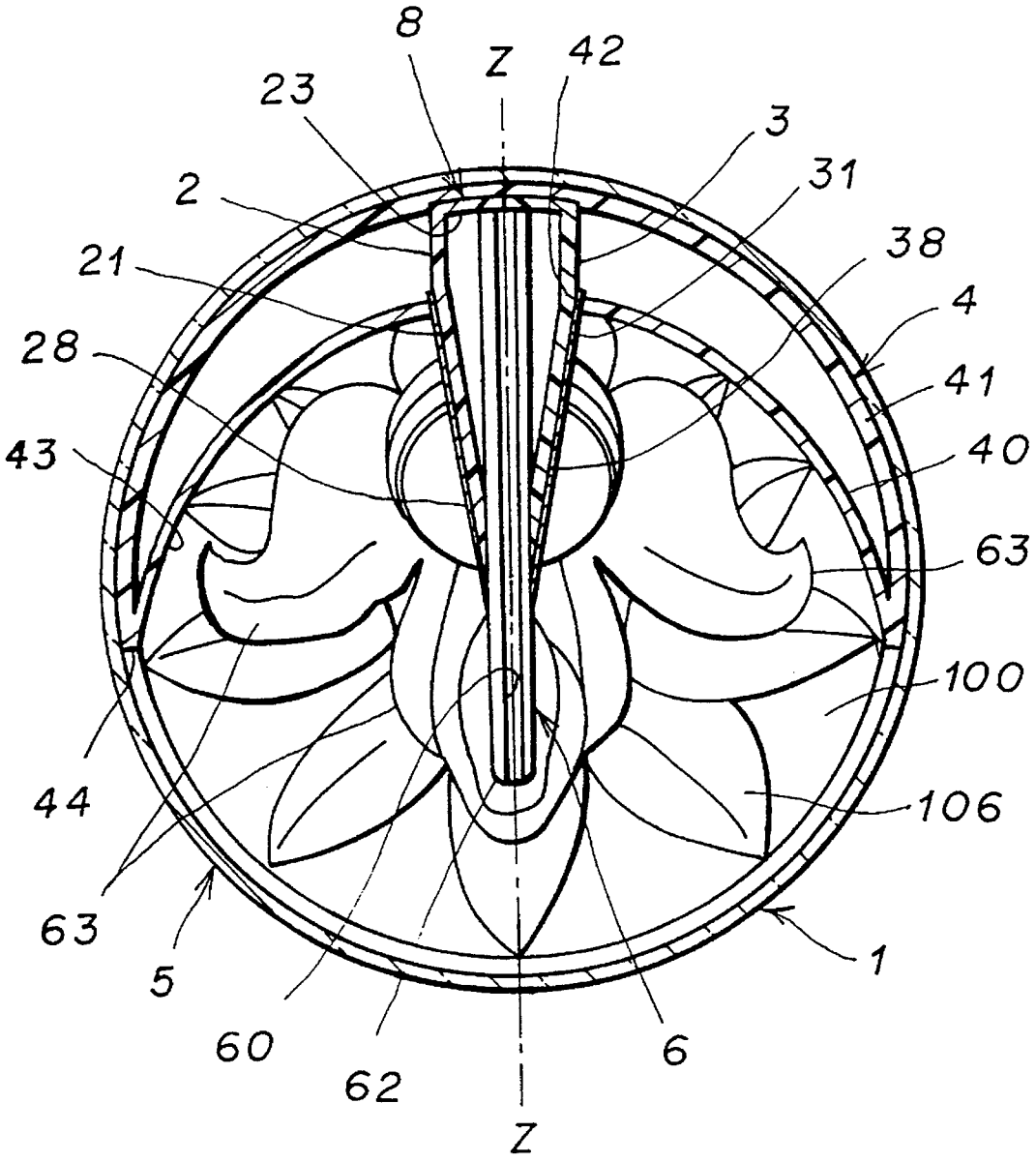
FIG. 5 is a sectional view taken along the line V—V in FIG. 1.

Note that the left and right coin concealing members 2 and 3 in FIG. 5 are designed horizontally symmetrical. So, for the simplicity of the explanation of the coin concealment 8, only the left member 2 is illustrated in FIGS. 8A through 8D.

The coin concealment 8 is made of, for example, a light-opaque synthetic resin. The coin concealing member 2 of the coin concealment 8 has a front face 20 extending as curved and elongated from the bottom to the top thereof, a side face 21 (31 of the member 3) formed flat for fixation of a mirror 28 (38 of the member 3), respectively, which will be described later, a rear face 23 formed generally flat but of which the upper portion is slightly curved, and a bottom face 24 formed generally flat for approximate fitting to the circumferential edge of the through-hole 101 formed in the top plate 100 of the upper case member 10. The upper portion of the front face 20 is formed like a petal of a rose and the lower portion thereof is formed like a stem of the rose. The upper and lower portions of the front face 20 form a camouflage which will be further discussed later. The front face 20 has formed nearly in the middle thereof a slot 25 through which a coin is to be received, and the bottom face 24 has formed therein an opening 29 which communicates with the through-hole 101 in the case 1. The left coin concealing member 2 has a small circular hole 26 formed in a generally central position on the inner side thereof (such a small circular hole is also formed in a corresponding position on the inner side of the member 3 but it is not shown in the drawings). Thus, the coin concealment 8 has an internal space 27 extending from the slot 25 to the opening 29 and of which the capacity is large enough to receive an oscillating coin chute 6 which will be described later.

The coin concealment 8 is fixed upright onto the case 1 by engaging the circumferential edge of the opening 29 into the engagement recess 104 formed along the through-hole 101.

The mirrors 28 and 38, provided on the left and fight side faces 21 and 31, respectively, of the coin concealment 8, are each made of a thin film of flexible synthetic resin having a generally same shape as those of the side faces 21 and 31 and on which an aluminum foil is bonded or an aluminum is evaporated. The mirrors 28 and 38 may be formed by bonding an aluminum foil or evaporating an aluminum directly onto the left and fight side faces 21 and 31 of the coin concealment 8".

The reference numerals 63 and 64 indicate members shaped like petals of a rose and fixed over the middle slot 25 to the front face 20 of the coin concealment 8 to camouflage the slot 25. The camouflaging members 63 and 64 and the front face 20 of the coin concealment 8 shaped like a rose stem will appear like a rose standing with a stem on the leaves (ornamental member 106) on the top plate 100 of the case 1 due to reflection by the mirrors 28 and 38.

The reference numeral 4 indicates a back screen disposed upright on the case 1. The back screen 4 includes an inner wall member 40 and outer wall member 41, made of a light-opaque synthetic resin, for example. As seen from FIG. 5, the inner wall member 40 has a cross-section nearly identical to the inner circular arc of the crescent-like cut 102. It has formed nearly in the center thereof an elongated hole 42 into which the rear face 23 of the coin concealment 8 can be introduced. The inner wall member 40 is engaged at the bottom end thereof in the engagement recesses 104 formed along the inner circumferential edge of the crescent-like cut 102 in the case 1. Also, a vertical stripe pattern is provided on the inner surface of the inner wall member 40, that is opposite to the mirrors 28 and 38 to form a camouflaging face 43.

The outer wall member 41 of the back screen 4 is formed by largely cutting off, at 44, a cylinder of which the top is formed like a dome and the bottom is open. Thus, the member 41 is open at both 44 and bottom thereof. A vertical-stripe pattern, the same as that on the camouflaging face 43 on the inner surface on the inner wall member 40, is also provided on the inner surface of the outer wall member 41 that is opposite to the camouflaging face 43 on the inner surface of the inner wall member 40, to form a camouflaging face. The outer wall member 41 has a bottom portion 45 having a toroidal shape of generally the same diameter as that of the circumference of the top plate 100 of the case 1. The bottom portion 45 has formed at the bottom end face thereof an engagement step 46 which is to be engaged in the engagement recess 104 in the top plate 100 of the case 1. Therefore, the coin concealment 8, mirrors 28 and 38, and camouflaging members 63 and 64 are disposed between the inner wall member 40 and a part of the outer wall 41 opposite to the inner wall member 40.

The back screen 4 has formed along the top edge thereof an engagement concavity 47 in which engagement projections 49 formed at the top of the left and fight coin concealing members 2 and 3 are to be engaged.

The vertical-stripe pattern on the back screen 4, especially, that on the inner wall member 40, that is, the camouflaging surface 43, will be seen through the large opening 44 due to the reflection by the mirrors 28 and 38. Hence, the reflection of the mirrors 28 and 38 will cause an illusion that the mirrors 28 and 38, and the coin concealing members 2 and 3 do not exist.

Figure 3:
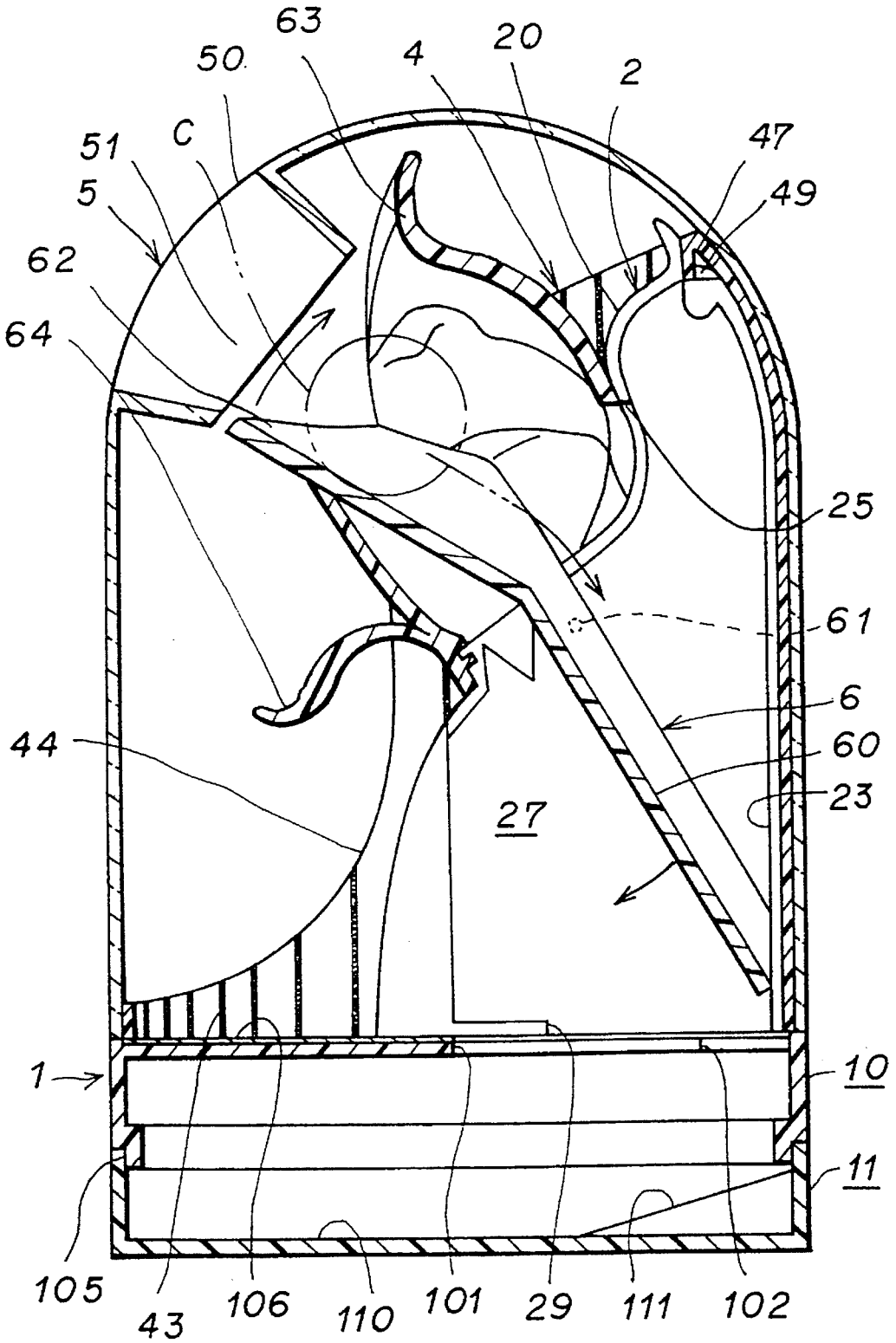
FIG. 3 is a sectional view taken along the line III—III in FIG. 1.
Figure 4:
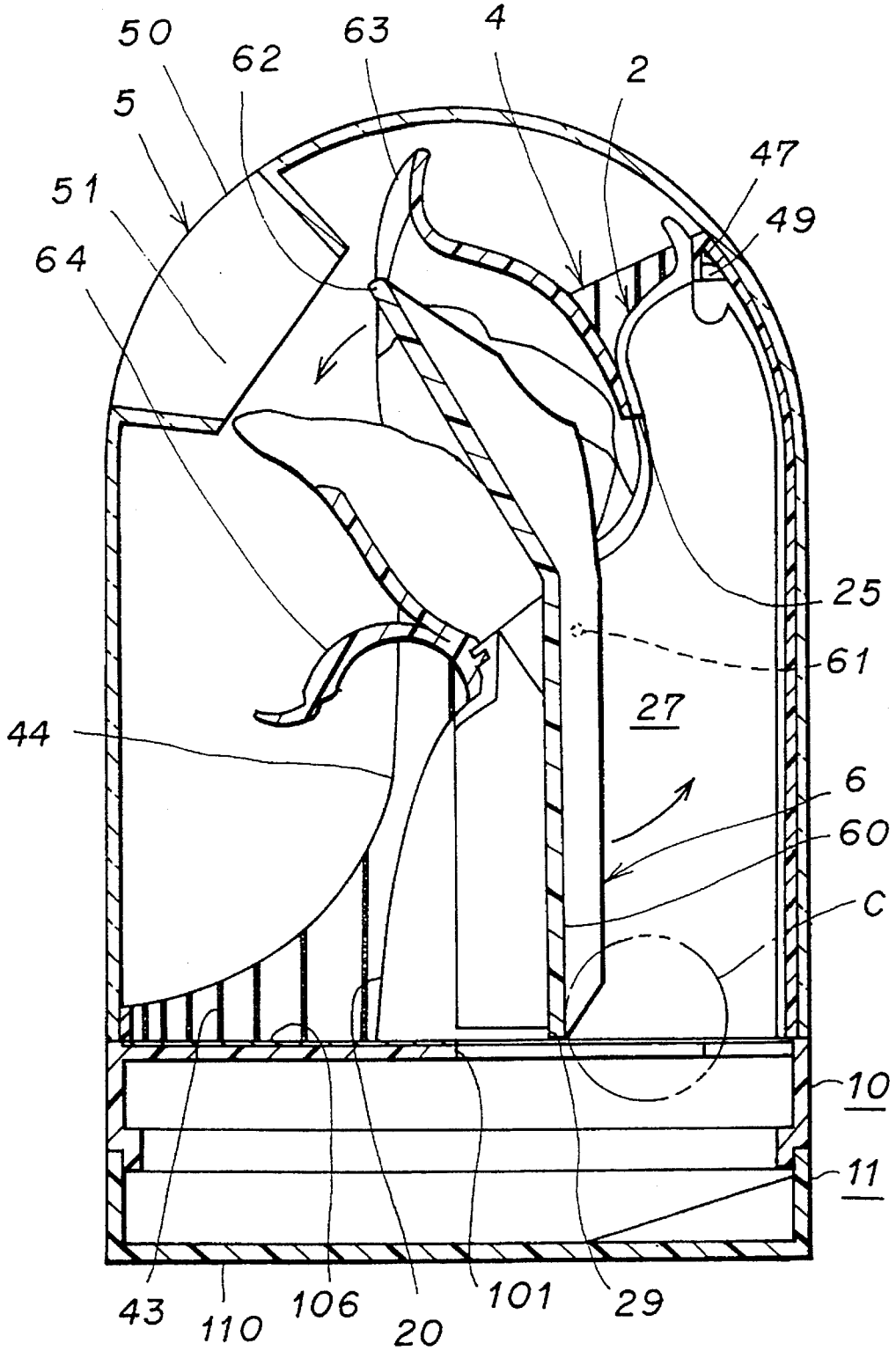
FIG. 4 is a sectional view showing the reception of a coin into the coin receiving case.

The reference numeral 6 indicates a coin chute which oscillates reciprocally as a coin C rolls down thereon. As shown in FIGS. 2, 3 through 5, the coin chute 6 is an elongated member bent nearly at the middle thereof. The coin chute 6 has formed integrally therewith on the lateral centers in positions corresponding to the bending thereof projections 61 which are pivotably supported in the small circular holes 26 formed in the left and right coin concealing members 2 and 3, respectively. The coin chute 6 has longitudinally formed therein a groove 60 of which the cross section is generally U-shaped to define a passage for the coin C. One end of the coin chute 6 is formed as a camouflaging member designed like one of the rose petals. It is exposed outside from the slit 25 in the coin concealment 8 and disposed between the camouflaging members 63 and 64. The other end of the coin chum 6 is disposed in the internal space 27 of the coin concealment 8. The coin chum 6 has a center of gravity a little shifted from the projections 61 toward the other end thereof, and so it normally takes a position as shown in FIG. 3. Therefore, when the coin C is put in through the slot 25 in the coin concealment 8 and rolls down along the groove 60, the coin chute 6 oscillates reciprocally. More particularly, when the coin C rolls down in the groove 60 in the coin chute 6, from the projections 61 toward the other end of the coin chute 6, the coin chum 6 will turn clockwise as shown in FIG. 4. After the coin C drops into the case 1, the coin chute 6 turns counterclockwise to the state shown in FIG. 3.

The savings box according to the present invention further comprises a light-transparent cover generally indicated with a reference numeral 5 and which is made of a transparent synthetic resin, for example. As shown in FIG. 1, the transparent cover 5 is made of a cylinder closed at a top portion thereof shaped like a dome and open at the bottom thereof. It is used as placed over the back screen 4. The cover 5 has formed integrally at the upper partition thereof a coin guide 51 of which one end 50 serves as a coin slot. When the savings box is assembled, the coin guide 51 is so positioned opposite to the front end of the coin chute 6 that a coin C put in from the coin slot 50 is guided to the front end of the coin chute 6. The transparent cover 5 is set as put at the bottom end opening thereof over the back screen 4, coin concealment 8, back screen 4, mirrors 28 and 38, camouflaging members 20, 63 and 64, and the coin chute 6.

In the savings box of the aforementioned construction according to the present invention, especially the vertical stripe pattern 43 on the inner wall member 40 is reflected at the mirrors 28 and 38 and is visible through the opening 44 of the back screen 4 so that the coin concealment 8 will appear as if it were missing. Also the camouflaging members 20, 62, 63 and 64 and the back screen 4 appear as if they stand upright on the case 1. As a result, a coin C put in from the coin slot 50 in the transparent cover 5 rolls along the coin guide 51 to the one end 62 of the coin chute 6 and is finally received into the case 1 through the through-hole 101. Since the movement of the coin C is hidden behind the coin concealment 8, however, an illusion that the coin C has gone to somewhere or is missing, is given. When the upper and lower case members 10 and 11 of the coin-receiving case 1 are disassembled from each other, the coin can be taken out of the case 1.

Especially in the savings box according to the present invention, the camouflaging member 62 formed at the front end of the coin chute 6 oscillates as the coin C rolls down along the coin chute 6. Namely, a part of the flower petal moves, which will assure an enhanced fun to use.

More particularly, when the coin C has passed through the V-groove 60 of the coin chute 6 in the direction of an arrow with a two-dot chain line in FIG. 3, and further moved from the one to other end of the coin chute 6, the coin chute 6 turns in the direction of an arrow with a solid line (clockwise) in FIG. 3 and the camouflaging member 62 at the one end of the coin chute 6 rises up to close the coin passage. When the coin C is passed from the V-groove 60 in the coin chute into the case 1, the coin chute 6 turns in the direction of the arrow with a solid line (counterclockwise) in FIG. 4 to open the coin passage. The one end of the coin chute 6 is made as the camouflaging member 62 like a rose petal and oscillates reciprocally as a coin C is passed along the coin chute 6, which will add the reciprocal motion of the camouflaging member 62 to the illusion of coin missing. Thus, the savings box according to the present invention can be great fun to use.

In this embodiment, the camouflaging members are designed like petals, stem and leaves of a rose and one end of the coin chute 6 is made like one of the rose petals. However, they are not limited only to such configurations. The camouflaging members may be constructed like a pelican standing with the long bill a little opened. In this case, the one end of the coin chute may be connected to the lower half of the pelican's long bill in such a manner that when the coin put in causes the coin chum to reciprocally oscillate, the pelican closes and opens the bill.

What is claimed is:

1. A savings box, comprising:

a coin-receiving hollow case having a through-hole formed in the top thereof;

a coin concealment member disposed upright on the top of the coin-receiving hollow case, having an internal space communicating with the through-hole in the coin receiving case via an opening at a lower end of the concealment member, said internal slot being, formed nearly in the middle of two outer flat faces which define a predetermined angle between them;

two mirrors fixed on the outer flat faces, respectively, of the coin concealment member;

a camouflaging member attached to the coin concealment member to cover the slot of the coin concealment member as viewed from outside of the savings box;

a back screen disposed upright on the top of the coin-receiving case and having a camouflaging face exposed to the two mirrors, the camouflaging face being so located that the two mirrors and coin concealment member will not be visible due to reflection of the camouflaging face by the mirrors; and a coin chute attached to the coin concealment so that the coin chute can be oscillated about a center of oscillation, a first end thereof being exposed out of the slot of the coin concealment member while a second end thereof is disposed in the coin concealment member, a coin passage being formed therein from the first to the second end;

the coin chute having a center of gravity displaced from the center of oscillation toward the second end thereof so that it oscillates reciprocally when a coin put in rolls on the coin passage.

2. A savings box according to claim 1, further comprising:

a transparent cover to cover the coin concealment member, two mirrors, camouflaging member, back screen and coin chute;

the cover being provided with a coin slot and a coin guide which guides a coin put in from the coin slot to said first end of the coin

3. A savings box according to claim 2, wherein the camouflaging member comprises a first ornamental member shaped to resemble petals and stem of a flower, the first end of the coin chute is shaped to resemble a petal of the flower and wherein a second ornamental member shaped to resemble leaves of the flower is fixed to the top of the coin-receiving case.

4. A savings box according to claim 1, wherein the camouflaging member comprises a first ornamental member shaped to resemble petals and stem of a flower, the first end of the coin chute is shaped to resemble a petal of the flower and wherein a second ornamental member shaped to resemble leaves of the flower is fixed to the top of the coin-receiving case.

* * * * *